US012083377B2

(12) United States Patent
DeAngelo

(10) Patent No.: US 12,083,377 B2
(45) Date of Patent: Sep. 10, 2024

(54) STATIONARY BIKE HANDLEBAR COVER

(71) Applicant: Eugenia DeAngelo, Foxborough, MA (US)

(72) Inventor: Eugenia DeAngelo, Foxborough, MA (US)

( * ) Notice: Subject to any disclaimer, the term of this patent is extended or adjusted under 35 U.S.C. 154(b) by 183 days.

(21) Appl. No.: 17/885,501

(22) Filed: Aug. 10, 2022

(65) Prior Publication Data

US 2023/0050457 A1 Feb. 16, 2023

Related U.S. Application Data

(60) Provisional application No. 63/260,238, filed on Aug. 13, 2021.

(51) Int. Cl.
*A63B 21/00* (2006.01)
*A63B 22/06* (2006.01)

(52) U.S. Cl.
CPC ..... *A63B 21/4035* (2015.10); *A63B 22/06* (2013.01); *A63B 2225/685* (2013.01)

(58) Field of Classification Search
CPC ..... A63B 22/06; A63B 2225/685
See application file for complete search history.

(56) References Cited

U.S. PATENT DOCUMENTS

| | | | | |
|---|---|---|---|---|
| 6,220,997 | B1 | 4/2001 | Kohl | |
| D556,490 | S | 12/2007 | Bastian | |
| D752,162 | S | 3/2016 | Adrig | |
| 9,795,856 | B2 * | 10/2017 | Seilus | A63B 71/00 |
| D852,545 | S | 7/2019 | Hiller | |
| D898,480 | S | 10/2020 | Hiller | |
| 10,945,565 | B2 | 3/2021 | Kasten | |
| D926,496 | S | 8/2021 | Hiller | |
| 2005/0194502 | A1 * | 9/2005 | Montgomery | F16M 13/00 248/174 |
| 2007/0099779 | A1 | 5/2007 | Boehm et al. | |
| 2009/0000060 | A1 | 1/2009 | Edens | |
| 2010/0147102 | A1 * | 6/2010 | Egan | B62K 21/26 74/551.9 |
| 2015/0041603 | A1 * | 2/2015 | Kinder | A47K 10/02 112/475.08 |

* cited by examiner

*Primary Examiner* — Vicky A Johnson

(57) ABSTRACT

A handlebar glove-like cover system for use on an exercise device wherein the cover system includes a generally U-shaped handlebar cover with a support band extending therebetween to provide support for items used by the user during the exercise program and the glove-like handlebar cover extends along and covers the majority of the handlebar of the exercise device while giving the user's hands a reliable grip and circumferential access to common riding positions.

19 Claims, 5 Drawing Sheets

STATIONARY BIKE HANDLEBAR COVER

BACKGROUND OF THE INVENTION

Stationary bikes are bicycles coupled to a stationary platform, which may provide exercise options at a stationary location. An improved stationary bike glove-like cover is provided wherein a cloth material is provided to cover the handlebars of the stationary bike to provide secure grip, friction, padding and absorption and a further elastic band is oriented to extend between the handlebars to prevent movement of the cover and to hold accessories such as a phone, headphones, towel ring, a baby monitor, or support a laptop or other items while using the stationary bike.

In US Publication No. 2005/0194502 filed by Montgomery, a handlebar storage unit is disclosed. The unit includes a pair of handlebars receiving portions which are wrapped around the parallel portions of the handlebar and a support portion is stretched between the handlebar receiving portions. The support portion forms a surface for the user to place items during exercise and includes one or more pockets. A further embodiment discloses a continuous loop unit which is formed from a sheet of material with a four way stretch material that is looped around the handlebars like a fitted sheet.

In US Publication No. 2005/0194502 filed by Kinder, a handlebar storage unit is disclosed. In this publication a towel device is shown as extending between the handlebars and includes a pair of fabric loops that are positioned over the handlebars.

In U.S. Pat. No. 10,945,565 granted to Kasten, a removable towel for exercise equipment is disclosed. In this patent, a variety of towel configurations are disclosed for use on multiple stationary bike configurations.

The present invention is directed to an improved handlebar cover and support system that is adaptable for use on multiple styles of stationary bike and the glove-like fit allows access to most riding positions without extra material draped across the entire handlebar. A further feature of the present invention is to provide a secure support surface for a laptop or similar device.

BRIEF DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views.

DEFINITIONS

The instant invention is most clearly understood with reference to the following definitions.

As used herein, the singular form "a," •'an," and "the" include plural references unless the context clearly dictates otherwise. Unless specifically stated or obvious from context, as used herein, the term "about" is understood as within a range of normal tolerance in the art. Unless otherwise clear from context, all numerical values provided herein are modified by the term about. As used in the specification and claims, the terms "comprises," "comprising," "containing;' "having," and the like may have the meaning ascribed to them in U.S. patent law and may mean "includes," "including," and the like. Unless specifically stated or obvious from context, the term "or," as used herein, is understood to be inclusive. Ranges provided herein are understood to be shorthand for all of the values within the range.

DETAILED DESCRIPTION OF THE INVENTION

A stationary bike handlebar glove-like cover system, and methods of use, are described herein. The glove-like cover system may include a handlebar fabric portion for covering the handlebars of a stationary bike, and an elastic or stretchable support band coupled to the handlebar fabric portion. The handlebar fabric portion may include a slit running the length of the handlebar fabric portion, allowing the handlebars of the stationary bike to be inserted into the handlebar fabric portion. The elastic support band may also include multiple strips of fabric across the gap formed by the handlebars. A laptop bottom component (e.g., the housing including the keyboard, memory, CPU, touchpad, etc.) may be slid between the handlebar and the support band, thereby securing the laptop to the handlebars.

Figure 1:
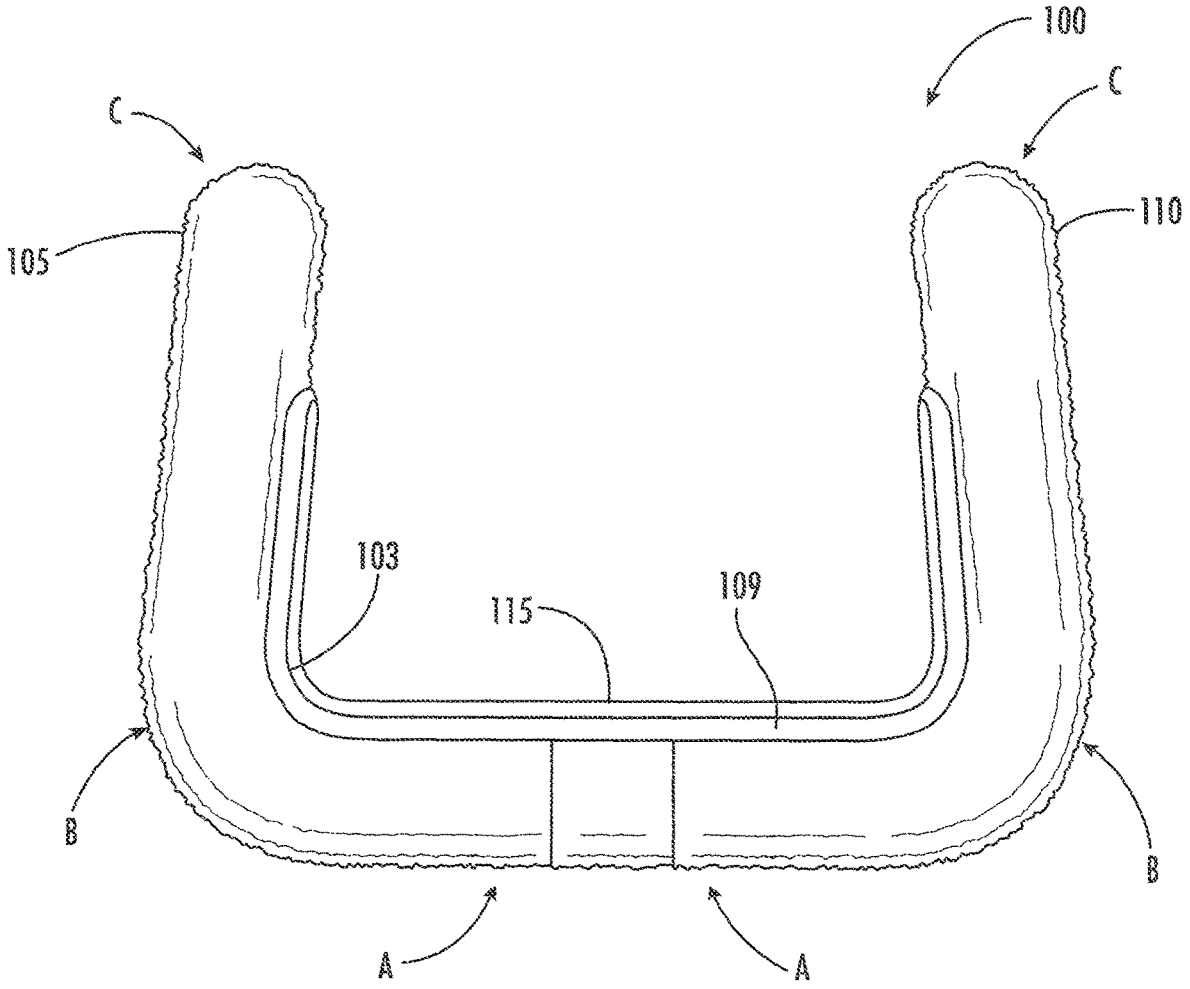
FIG. 1 depicts a stationary bike handlebar cover according to an embodiment of the present disclosure.

FIG. 1 depicts a fabric handlebar cover portion 100 according to an embodiment of the present disclosure. The handlebar cover portion 100 may include a first annular region 105 and a second annular region 110. In a preferred form of the present invention, the cover portion 100 may be formed of a sweat absorbing material such as a terry cloth and more preferably of an antimicrobial terry cloth material with silver or materials having similar properties. The cover portion 100 is generally U-shaped and preferably provides absorbency, cushion and comfort while providing a reliable grip on the handlebars and access to most common riding positions for the workout. Many exercise bikes and routines use multiple hand positions during a workout. For example, certain workouts have the user place their hands directly in front of them on the handlebar in the area shown generally as A in FIG. 1 (known in the industry as "position 1" or "1$^{st}$ position"). In another workout, the user places their hands in the areas shown as B in FIG. 1 (known in the industry as '·position 2" or "2$^{nd}$ position"). This latter location is more of the standard hand position for a workout In yet another workout, the user's hands may be placed near the top of the handlebars shown as area C in FIG. 1 (known in the industry as "position 3" or "3$^{rd}$ position"). Each of these areas may be used during the same workout if the user is approximating a hill climb, sprint or other change in resistance and speed. During many workouts, the user will move their hands through the various positions while also moving from sitting and standing positions. The fabric portion provides a secure glove-like gripping surface for each of the areas of the handlebar and riding positions. A further benefit is that the fabric portion 100 is washable and reusable while also protecting the stationary bike from sweat and wear. The first annular region 105 may be configured to cover a first portion of the handlebar generally along hand region C, and the second annular region 110 may be configured to cover a second portion of the handlebar generally along complementary hand region C. The first annular region 105 and the second annular region 110 may be coupled to one another via a connecting region 115 as shown in FIG. 5 (e.g., via proximal ends of the first and second annular fabric regions).

The general U-shape of the handlebar cover portion 100 may be manipulated to assume the shape of a variety of handlebars (e.g., first handlebar, second handlebar, and connecting portion). The handlebar cover portion 100 may include a slit 103 that runs the length of the handlebar cover portion 100 along the connecting region 115, first annular region 105 and the second annular region 110, or in some cases the slit 103 may extend a sufficient length along the cover portion 100 sufficient to slide the handlebars into the handlebar cover portion 100 and then allow for the stretching of the connecting region 115 around the remainder of the handlebar along hand regions A and B. Further, the width of the handlebar cover portion 100 (e.g., the circumference of the fabric portion) may be sized such that the handlebar cover portion 100 covers or encloses at least a part and preferably the majority of the circumferential dimension of the handlebars. FIG. 5 illustrates a further preferred form of the fabric portion 100 wherein the first annular region 105 may have a preformed and generally cylindrical configuration such that the first annular region 105 is slid over the top end of the desired portion of the stationary bike handlebar such as hand region C. In a further preferred form of the present invention, the second annular region 110 may also preformed and generally cylindrical configuration such that the second annular fabric region may be slid over the top end of the second portion of the handlebar of the stationary bike generally along band region C. With this configuration, the connecting region 115 of the cover portion 100 may then be stretched along the rest of the handlebar and the handlebar is inserted through the slit 103 of the cover portion 100. With the stretchiness of the material of the cover portion 100, the fabric between the first and second annular portions may be stretched to fit around the handlebar for a snug fit that provides the user with a reliable grip for each of the exercise hand positions on the handlebar during the workout. As shown in FIG. 5, the slit 103 preferably extends from a location generally adjacent to the first annular region 105 to a location generally adjacent to the second annular region 110 to allow the cover portion 100 to be positioned over the entire handlebar when the annular regions 105 and 110 are positioned on the ends of the handlebar. Additionally, the slit 103 may include an elastic band 109 extending along the periphery of the opening formed by the slit 103 to provide added stretchiness and resilience when the cover portion 100 is positioned on the handlebar. The addition of the elastic band 109 also assists in ensuring that the slit 103 is substantially closed when the cover portion 100 is positioned on the handlebar to provide a reliable glove-like fit around the handlebar.

A further form of the present invention may include added gripping material along the interior of the annular regions 105 and 110 and/or the connecting region 115. The use of the additional gripping material allows the cover portion 100 to be used on multiple configurations of handlebars to provide a secure grip between the cover portion 100 and the handlebar. Additionally, the use of the gripping material allows the cover portion to be used with handlebars having a smaller circumference. When the gripping material is used on the interior of the annular regions 105 and 110, a more secure contact is created to reduce or prevent the rotation of the annular regions 105 and 110 around the ends of the handlebar in use. The gripping material may be formed of rubber, elastics or similar materials that are designed to increase the friction between the desired portion of the cover portion 100 and the handlebar.

Figure 2:
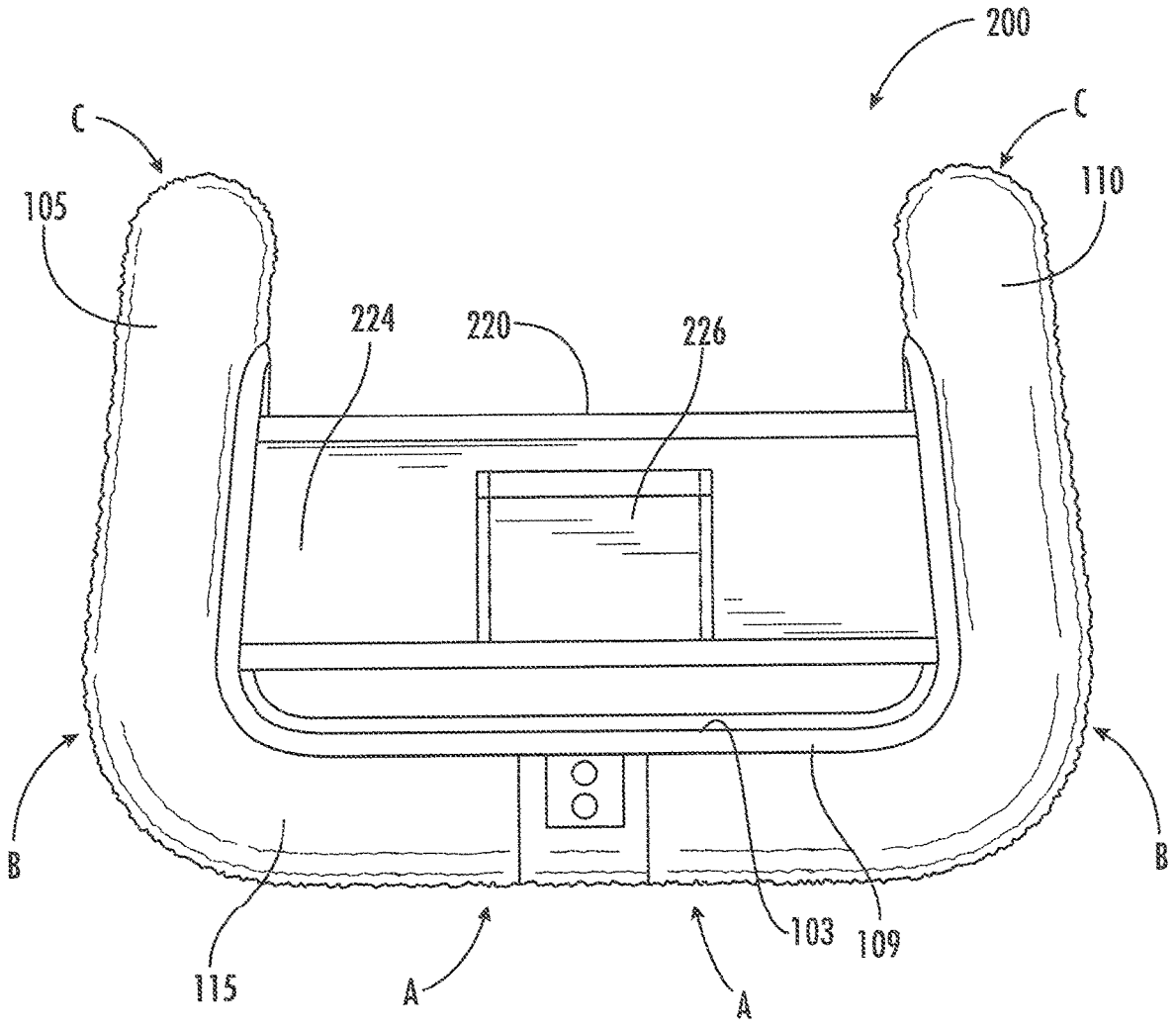
FIG. 2 depicts a stationary bike handlebar cover system according to an embodiment of the present disclosure.
Figure 3:
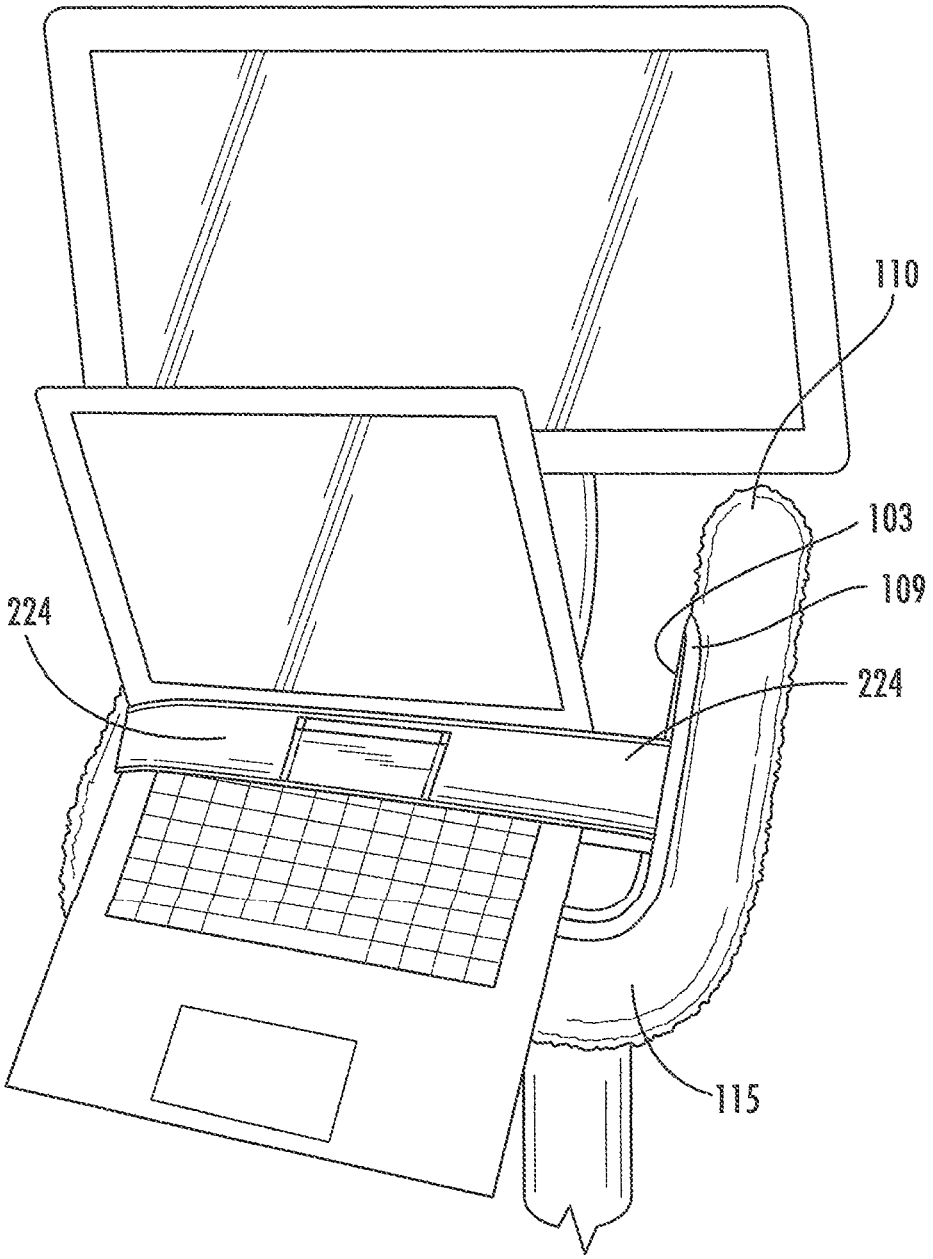
FIG. 3 depicts a top perspective image of a stationary bike handlebar cover system according to an embodiment of the present disclosure.
Figure 4:
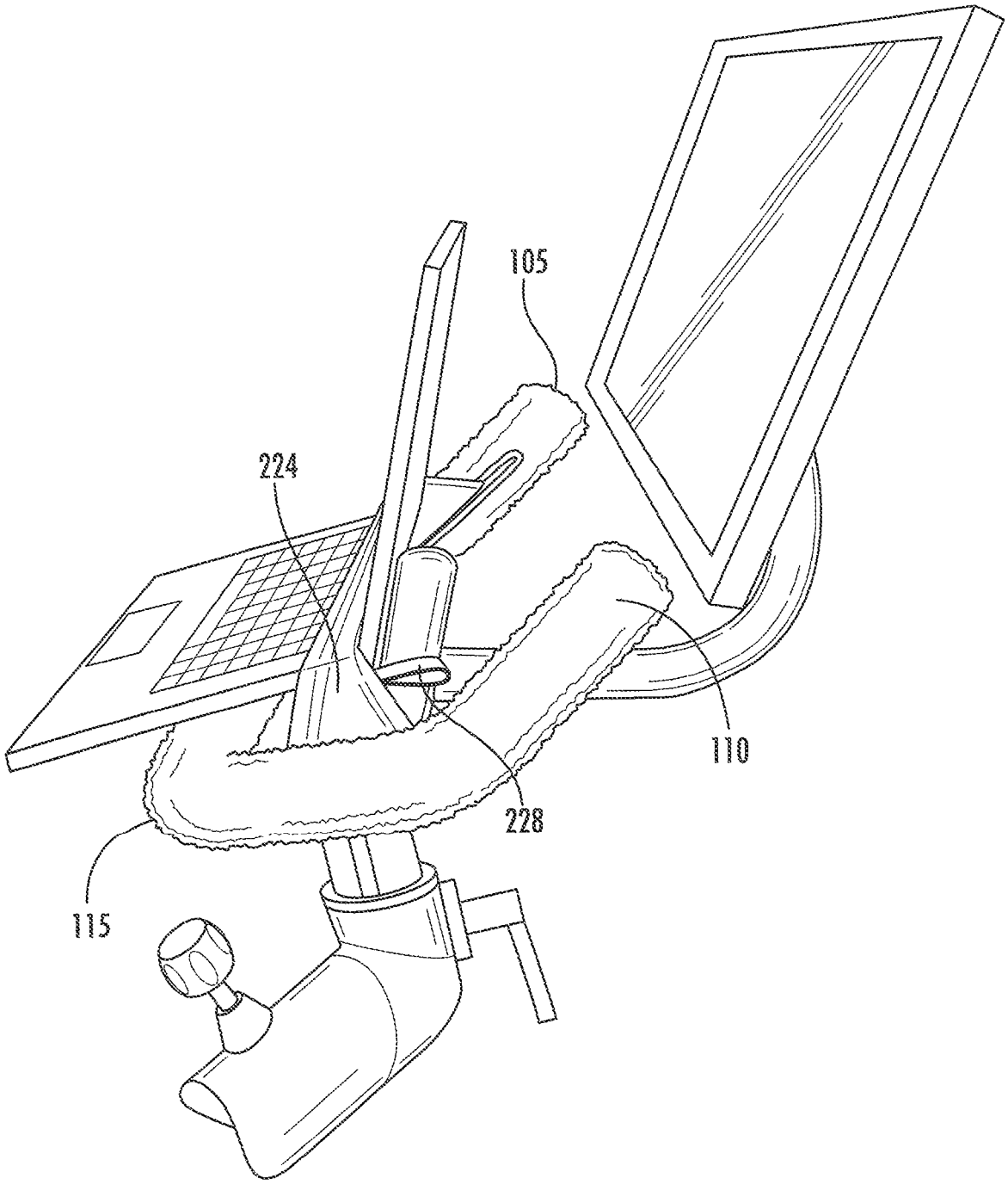
FIG. 4. depicts a side perspective image of a stationary bike handlebar cover system according to an embodiment of the present disclosure.
Figure 5:
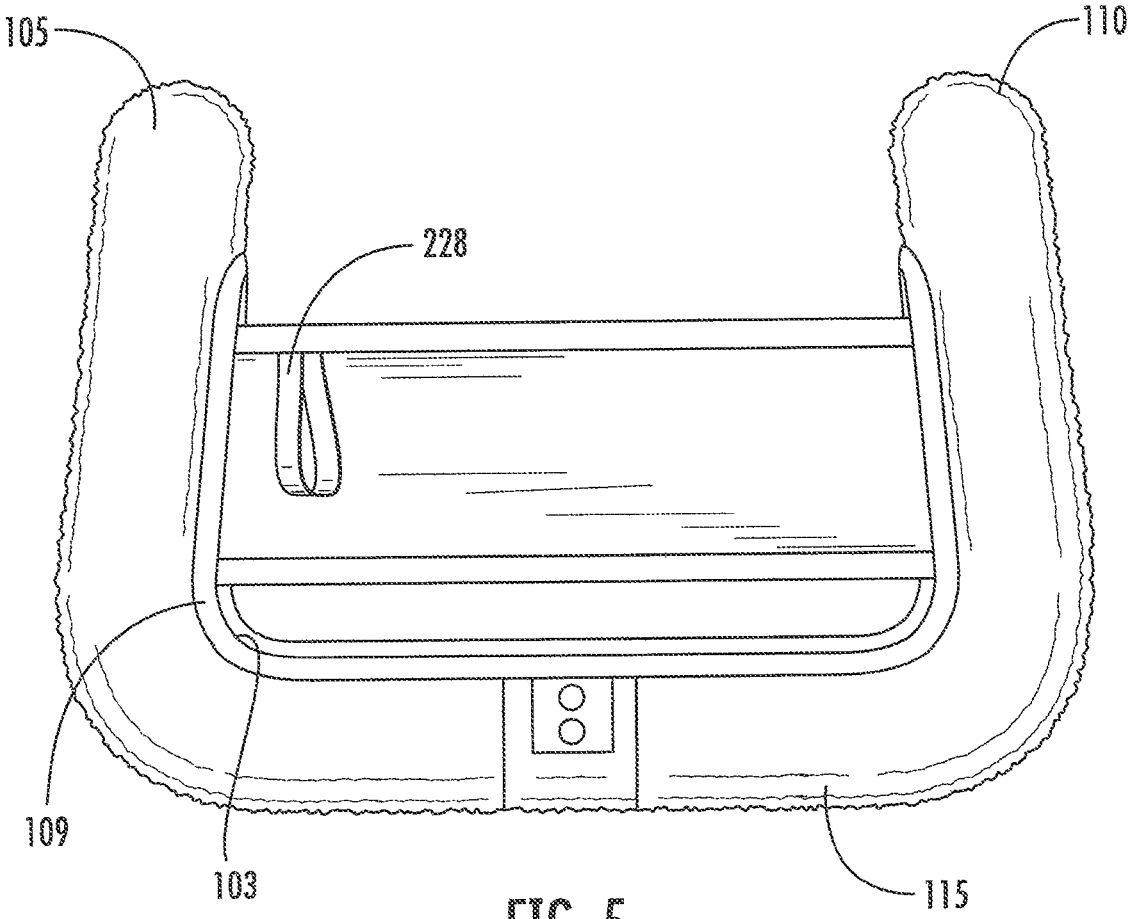
FIG. 5 depicts a bottom perspective image of a stationary bike handlebar cover system according to an embodiment of the present disclosure.

As shown in FIGS. 2-5, the cover system preferably also includes an clastic or stretchable support band 220. FIG. 2 depicts the top surface of the cover system 200 for stationary bike handlebars according to an embodiment of the present disclosure. The cover system 200 may include the handlebar cover portion, such as the handlebar cover portion 100 described above and as depicted in FIG. 1 and a flexible support band 220. The flexible support band 220 is preferably formed of a support portion 224. The fabric strip of the support portions may be attached lengthwise to a location that begins generally adjacent to or below the bottom of the first annular region 105, and the other end to a location that is generally adjacent to or below the bottom of the second annular region 110 and extends there below along the connecting region 115. As shown in FIG. 5, the preferred form of the present invention includes support portion 224 being sewn onto connecting region 115 and adjacent to the slit area 103 below each of the annular regions 105 and 110. Thus, the support portion 224 of the flexible support band 220 may form a loop positioned below the first annular region 105 and the second annular region 110 such that the support band is stretched and positioned between the two upright portions of the handlebar. The support band 220 is positioned along the cover portion 100 such that the preferred hand regions, A, B, and C are available for use by the user without interference from the support band 220. As shown, the support band 220 is positioned below the first and second annular regions to allow access to the hand region C. The support band 220 is also positioned above the portion of the connecting region 115 adjacent to the hand regions A and B to provide an open area for the user to position their hands on the respective hand regions without interference from the support band 220.

The cover system 200 may be composed of a variety of materials. For example, the cover system 200 may include wicking and/or absorbent material, such as polyester, polypropylene, foam, wool, merino wool, nylon, micromodal, bamboo, cotton, towel terry, and the like. In some cases, the cover system 200 may also include elastomeric material, for example, rubber, latex, neoprene, and the like. In other cases, the composition of the cover system 200 may be uniform throughout, such that the handlebar cover portion 100 and the support band 220 are composed of the same material. In some cases, the support band 220 may include a different composition than the handlebar cover portion 100 (e.g., where the support band 220 includes elastic materials and the cover portion 100 includes moisture wicking material). For example, the support band 220 may be composed of an elastomeric material. In some cases, the support band 220 may be composed of other materials that include elasticity properties, for example, terry, cotton polyester, and the like. Furthermore, the support portion 224 may be formed of the same material as the cover portion 100 or may be formed of a stronger or less stretchy material than the cover portion 100 to allow the support portion 224 to retain the item in the desired position between the handlebar and support portion 224.

The device described herein may be implemented to cover the handlebars of a stationary bike. The cylindrical shaped first and second annular regions, 105 and 110, of the handlebar cover portion 100 may be slid onto the handlebars of the stationary bike. The cover portion 100 may then be stretched to allow the connecting region 115 to fit over the remainder of the handlebar by fitting the handlebar through the slit 103 of the cover portion 100 such that the slit 103 is positioned generally along the inner side or surface of the handlebar and the connecting region 115 surrounds the remainder of the handlebar. The elastic band 109 along the slit 103 contracts the slit 103 to close the opening in the cover portion 100. In the preferred form, the handlebar cover portion 100 may be positioned on top and around the majority of the stationary bike handlebars to provide the user with a reliable gripping surface during each exercise hand position.

As shown in FIG. 2, the flexible support band 220 may also include a pocket member 226 along the support portion 224 to hold the phone or similar device of the user during exercise. Additionally, a towel loop 228 may be attached to the front or bottom surface of the support portion 224 to allow the user to attach a towel to the cover system 200 during exercise. As shown, a towel positioned in the towel loop 228 may be readily accessible for the user during the exercise session. The gap formed when the first annular region 105 and second annular region 110 are positioned on the handlebars will apply tension to the support portion 224, of the support band 220 to retain and support a laptop or similar device against the handlebar (e.g., allowing a user to view media such as exercise programming, instructional videos, movies, televisions, documents, and the like), to allow the user to participate in video, and the like while exercising. The device may be sized for a particular stationary bike (e.g., PELOTON® brand stationary bicycles available from Peloton Interactive, Inc. of New York, New York) or may be adjustable to fit multiple types of stationary bikes (i.e. STAGES, ECHELON, SUNNY or other brands of exercise bikes). For example, one or more portions 105, 110 and 115 may include elastic materials, include a hook-and-loop fastening system (e.g., VELCRO13)), drawstrings and the like to adjust to various handlebar dimensions.

FIGS. 3 and 4 depict images of the cover system for stationary bike handlebars, with an open laptop secured to the stationary bike handlebars via the cover system 200. The laptop may be positioned between the support portion 224 of the support band 220 and the handlebar. For example, the bottom portion of the laptop may be slid along the handlebar to support the weight of the laptop, while the support portion 224 may retain the laptop in the desired position and prevent the laptop from tipping over off the handlebars (e.g., with a region of the bottom laptop portion resting on the crossbar of the handlebars).

FIG. 5 depicts the bottom surface of the cover system 200 for stationary bike handlebars according to an embodiment of the present disclosure. In this embodiment, the handlebar fabric portion (e.g., handlebar cover portion 100 of FIG. 1) includes the elongate slit 103 on the interior surface, such that the connecting region 115 of the handlebar fabric may be wrapped around the outer surface of a handlebar set so as to cover the handlebars. The towel loop 228 may be sized (e.g., in width, length) to act as a clip, such as for keys of a stationary bike user while traveling to
or during use at an external studio. In some cases, the towel loop 228 may be sized to receive a towel through the loop (e.g., for securing the towel to the handlebar cover). The towel loop 228 is generally positioned such that the towel is readily reachable during exercise and does not interfere with the desired hand positions of the user.

EQUIVALENTS

Although preferred embodiments of the invention have been described using specific terms, such description is for illustrative purposes only, and it is to be understood that changes and variations may be made without departing from the spirit or scope of the following claims.

INCORPORATION BY REFERENCE

The entire contents of all patents, published patent applications, and other references cited herein are hereby expressly incorporated herein in their entireties by reference.

The invention claimed is:

1. A handlebar glove-like cover system for use on an exercise device, the cover system comprising:

a generally U-shaped handlebar cover and a generally rectangularly shaped support band extending therebetween;

a first annular region formed as a generally cylindrical shaped member on a first end of the handlebar cover configured to cover and enclose a first end of a handlebar;

a second annular region formed as a generally cylindrical shaped member on a second end of the handlebar cover configured to cover and enclose a second end of a handlebar;

a connecting region on the handlebar cover extending between the first annular region and the second annular region adapted and configured to cover and enclose the majority of the remainder of the handlebar;

a slit extending lengthwise along the connecting region wherein the slit extends from a location near the first annular region to a location near the second annular region and wherein the slit is sized to allow the handlebar to be inserted therein;

the support band having first and second ends wherein the first end is attached to the connecting region between a location near the first annular fabric region to a location spaced apart therefrom and the second end is attached to the connecting region between a location near the second annular fabric region to a location spaced apart therefrom; and an open region that is formed between the support band and a portion of the connecting region to allow the user to grip the handlebars at a location between the connecting region and the support band during exercise.

2. The system of claim 1, wherein the first annular region, the second annular region, and the connecting region are a single piece of fabric.

3. The system of claim 1, wherein the first annular region, the second annular region, and the connecting region comprise a flexible and moisture absorbent material.

4. The system of claim 1, wherein the slit extends along the interior of the U shape of the connecting region of the handlebar cover.

5. The system of claim 1 wherein the slit includes an elastomeric material along the periphery thereof to allow the connecting region to restrict the slit along the circumference of the handlebar.

6. The system of claim 1 wherein the support band includes support portion that is formed of a stretchy material and is positioned to allow the user to place items between the support portion and the handlebar of the exercise bike wherein the item is supported by the handlebar and retained in the desired position by the support portion.

7. The system of claim 6 wherein the material of the support portion is different than the material of the handlebar cover.

8. The system of claim 6 wherein the second support portion includes a pocket therein.

9. The system of claim 6 wherein the first support system includes a towel loop thereon.

10. The system of claim 1 wherein the support band is affixed to the connecting region and is aligned adjacent to the slit.

11. The system of claim 10 wherein the slit extends along the connecting region to a location between the support band and the first annular region and a location between the support band and the second annular region.

12. A handlebar glove-like cover system for use on an exercise device, the cover system comprising:

a generally U-shaped handlebar cover and a generally rectangularly shaped support band extending therebetween;

a first annular region formed as a generally cylindrical shaped member on a first end of the handlebar cover configured to cover and enclose a first end of a handlebar;

a second annular region formed as a generally cylindrical shaped member on a second end of the handlebar cover configured to cover and enclose a second end of a handlebar;

a connecting region on the handlebar cover extending between the first annular region and the second annular region adapted and configured to cover and enclose the majority of the remainder of the handlebar;

a slit extending lengthwise along the connecting region wherein the slit extends from a location near the first annular region to a location near the second annular region and wherein the slit is sized to allow the handlebar to be inserted therein and the slit extends along the interior of the U shape of the handlebar cover to provide a reliable gripping surface on the handlebar;

the support band having first and second ends wherein the first end is attached to the connecting region between a location near the first annular fabric region to a location spaced apart therefrom and the second end is attached to the connecting region between a location near the second annular fabric region to a location spaced apart therefrom;

wherein the support band further includes a support portion wherein the support portion is positioned to allow the user to place items between the support portion and the handlebar of the exercise device wherein the item retained in the desired position by the support portion; and an open region that is formed between the support band and a portion of the connecting region to allow the user to grip the handlebars at a location between the connecting region and the support band during exercise.

13. The system of claim 12 wherein the slit includes an elastomeric material along the periphery thereof to allow the connecting region to restrict the slit along the circumference of the handlebar.

14. The system of claim 13 wherein the support band includes an elastic support portion wherein the support portion allows the user to place items beneath the support portion and wherein the item is supported by the handlebar of the exercise bike and retained in the desired position by the support portion.

15. A handlebar cover system for use on an exercise device, the cover system comprising:

a generally U-shaped handlebar cover and a generally rectangularly shaped support band extending therebetween;

a first annular region formed as a generally cylindrical shaped member on a first end of the handlebar cover configured to cover and enclose a first end of a handlebar;

a second annular region formed as a generally cylindrical shaped member on a second end of the handlebar cover configured to cover and enclose a second end of a handlebar;

a connecting region on the handlebar cover extending between the first annular region and the second annular region adapted and configured to cover and enclose the majority of the remainder of the handlebar;

a slit extending lengthwise along the connecting region wherein the slit extends from a location near the first annular region to a location near the second annular region and wherein the slit is sized to allow the handlebar to be inserted therein and the slit extends along the interior of the U shape of the handlebar cover;

the support band having first and second ends wherein the first end is attached to the connecting region between a location near the first annular fabric region to a location spaced apart therefrom and the second end is attached to the connecting region between a location near the second annular fabric region to a location spaced apart therefrom;

wherein the support band further includes an elastic support portion wherein the support portion is positioned to allow the user to place items between the support portion and the handlebar of the exercise bike and the item is supported by the handlebar and retained in the desired position by the support portion; and wherein the slit extends along the connecting region to a location between the support band and the first annular region and a location between the support band and the second annular region.

16. The system of claim 15 wherein an open region is formed between the support band and a portion of the connecting region to allow the user to grip the handlebars at a location between the connecting region and the support band during exercise.

17. The system of claim 15 wherein the slit includes an elastomeric material along the periphery thereof to allow the connecting region to restrict the slit along the circumference of the handlebar.

18. The system of claim 15 wherein the first annular region and second annular region include an interior surface having a gripping material thereon to reduce movement between the first annular region and second annular region and the handlebar.

19. The system of claim 15 wherein the connecting region of the handlebar cover includes an interior having a gripping material thereon the reduce movement between the connecting region and the handlebar.

* * * * *